US009248645B1

(12) United States Patent
Mandel et al.

(10) Patent No.: US 9,248,645 B1
(45) Date of Patent: Feb. 2, 2016

(54) CONTROL METHOD TO REDUCE PRINTHEAD DAMAGE AND CONTAMINATION

(71) Applicant: Xerox Corporation, Norwalk, CT (US)

(72) Inventors: Barry P. Mandel, Fairport, NY (US); Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/615,876

(22) Filed: Feb. 6, 2015

(51) Int. Cl.
*B41J 2/165* (2006.01)
*B41J 2/045* (2006.01)

(52) U.S. Cl.
CPC ..... *B41J 2/04556* (2013.01); *B41J 2/04586* (2013.01)

(58) Field of Classification Search
USPC ..... 347/8, 29, 42, 23
See application file for complete search history.

(56) References Cited

U.S. PATENT DOCUMENTS

| | | | | |
|---|---|---|---|---|
| 5,363,132 | A | 11/1994 | Ikkatai | |
| 6,336,718 | B1 | 1/2002 | Blanchard, Jr. et al. | |
| 6,955,415 | B2 | 10/2005 | Koblinger et al. | |
| 7,850,271 | B2 | 12/2010 | Gothait et al. | |
| 8,668,305 | B2 * | 3/2014 | Achatz et al. | 347/29 |
| 2012/0092403 | A1 | 4/2012 | Profaca et al. | |

* cited by examiner

*Primary Examiner* — Lam Nguyen
(74) *Attorney, Agent, or Firm* — Maginot Moore & Beck LLP

(57) ABSTRACT

A printing device includes an array of printheads, an actuator, and a controller. The actuator is configured to move the printheads between: a first distance from a surface on which an ink image is to be formed that enables the printheads to eject ink and form a portion of the ink image on the surface; and a second distance from the surface that is greater than the first distance. Both the first and second distances are within a print zone of the printing device. The controller is configured to identify at least one printhead that is not used for a portion of a print job, and is further configured to operate the actuator to move the identified printhead to the second distance from the surface.

13 Claims, 9 Drawing Sheets

CONTROL METHOD TO REDUCE PRINTHEAD DAMAGE AND CONTAMINATION

TECHNICAL FIELD

This disclosure relates generally to inkjet printers, and, in particular, to the reduction of printhead damage and contamination.

BACKGROUND

Imaging devices such as inkjet printers typically operate one or more printheads that are configured to eject ink for marking media. In direct marking printers, the ink is applied directly to the media, rather than to an intermediate printing surface. The media can be, for example, a surface of a continuous web of media material, a series of media sheets, or other surfaces that are desirably marked. A printhead controller typically controls the one or more printheads by generating a firing signal with reference to image data.

Two or more printheads can be mounted linearly, or in other configurations, to a support structure, to form an array of printheads. In array printing devices, printheads are arranged to extend over the print media in a cross-process direction, which is perpendicular to a direction of media movement in the plane of the media movement. A distance between the printheads and the imaging surface is carefully selected to optimize the imaging process. If the gap is too small, burnishing of the printheads can occur when the image receiving surface contacts the face of the printheads. Burnishing not only reduces the life of the printheads, but results in poor image quality, unintentional markings, and increased downtime of the printer during maintenance. If the gap is too large, image quality suffers, particularly in high speed printers, where a large gap can result in decreased accuracy of the ejected drops forming the printed image. A nominal gap distance between printheads and an image receiving surface can be, for example, about 1 mm or less.

In imaging devices for printing images on separate sheets of media, sheets of media are sequentially fed through the imaging device. Each media sheet has a leading edge that may be susceptible to dislocation, curling, wrinkling, or other types of distortion, and printheads in cut sheet imaging devices are at risk to burnishing and damage. While the media in continuous-feed imaging devices do not have leading edges, height distortions, such as seams and wrinkles, can be present in continuous media webs and thus also risk impacting printheads. Systems have been produced for adjusting the gap between printheads and the imaging surface, but involve interrupting the printing process, are not optimized for high-speed printing, or result in a decrease in fidelity or accuracy in the printed image.

An additional risk involves contaminant accumulating on printheads from sources such as ejected ink from other printheads, dust, particulates from the media, or the like. Dust particulates and other contaminations can clog nozzles. When printheads are in close proximity to one another, ejected ink from one printhead may splash or spray onto another. While devices have been produced that can be used to clean or wipe a printhead, such use often interrupts the printing process and involves what can be complex maintenance devices and procedures. Further, wiping mechanisms can potentially exacerbate these risks by pushing particulates into the nozzle openings.

These risks are compounded when, as in many modern imaging devices, a plurality of different printheads are included in a device. Including more printheads in an imaging device increases the chance that media distortion or contamination results in damage to one of the printheads that can negatively impact the lifespan of printheads. Therefore, systems and methods that reduce printhead damage and contamination in imaging devices operating at a high rate of speed without interrupting the printing process or impacting the quality of the printed image would be beneficial.

SUMMARY

To reduce damage and contamination of printheads in a printer while minimizing interruption to the printing process or impacting the quality of an image to be printed, a printer includes a plurality of printhead arrays, an actuator, and a controller. Each of the plurality of printhead arrays has a respective plurality of printheads that form an array extending in a cross-process direction across a media path within a print-zone in the printing device. The actuator is configured to move at least one of the printhead arrays in a direction normal o a surface on which an ink image is to be formed, between a first distance from the surface and a second distance from the surface. The first distance is within the print zone and enables the at least one printhead array to eject ink for forming a portion of the ink image on the surface. The second distance is greater than the first distance and is within the print zone. The controller is operatively connected to the actuator and is configured to identify at least one of the plurality of printhead arrays as unused for at least a portion of at least one print job to be completed by the printing device and as being at the first distance from the surface, and move the at least one identified printhead array by operating the actuator to position the at least one identified printhead array at the second distance from the surface to enable the at least one identified printhead array to remain at the second distance from the surface during the portion of the at least one print job in which the at least one identified printhead array is unused.

A method of operating an array printing device to reduce printhead damage and contamination includes identifying at least one printhead array that is not to be used for at least a portion of at least one print job to be completed by the printing device. The at least one identified printhead array has a plurality of printheads that form an array that extends in a cross-process direction across a print-zone in the printing device. The at least one identified printhead array is positioned at a first distance from a printing surface that enables the at least one identified printhead array to eject ink for forming a portion of an ink image on the printing surface within the print zone of the printing device. The method further includes moving the at least one identified printhead array in a direction normal to the printing surface to a second distance from the print surface that is greater that the first distance but still within the print zone to enable the at least one identified printhead array to remain at the second distance from the print surface during the portion of the at least one print job in which the at least one printhead array is unused.

BRIEF DESCRIPTION OF THE DRAWINGS

The foregoing aspects and other features of the present disclosure are explained in the following description, taken in connection with the accompanying drawings.

DETAILED DESCRIPTION

Figure 1:
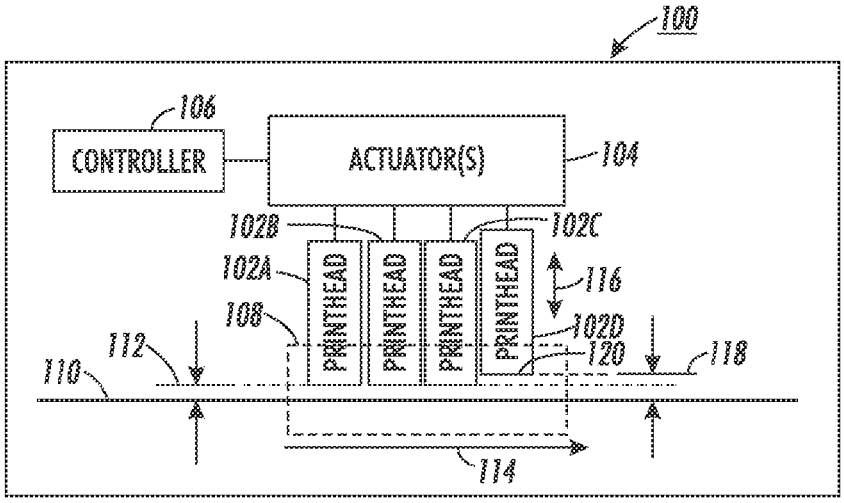
FIG. 1 is a schematic side view of an exemplary embodiment of a printing device that reduces printhead damage and contamination in a printing device.

For a general understanding of the present embodiments, reference is made to the drawings. In the drawings, like reference numerals have been used throughout to designate like elements.

As used herein, the term "printer" generally refers to a device for producing an ink image on print media. "Print media" can be a physical sheet of paper, plastic, or other suitable physical material that provides a surface for receiving ejected ink and forming ink images. The printer may include a variety of other components, such as finishers, paper feeders, and the like, and may be embodied as a copier, fax machine, or a multifunction machine. An ink image corresponds to image data stored in a memory in electronic form. The image data are rendered to generate electrical driving signals that are electrically connected to actuators to eject ink from one or more printheads to form an ink image on print media. The image data are rendered by a marking engine and such image data may include text, graphics, pictures, and the like.

A "gap" or "gap distance" means a distance between the print surface of media and a printhead. The term "printhead" refers to a single marking material ejecting device or to a plurality of such devices arranged in an array to cover a cross-process width of media in a printing device. An "array" or "printhead array" means a plurality of printheads that are mounted such that they enable printing over a width that is larger than the width of a single printhead. A printhead array can include a plurality of printheads that extend linearly in the cross-process width of the media, or can include a plurality of printheads that extend in a staggered fashion that generally extends in the cross-process direction. In some cases, a printhead array extends across less than a full extent of the width of the media such as, for example, a printhead array configured for different sized media such as envelopes or cards.

As noted above, a gap distance between the media and the printhead is carefully selected. A nominal gap distance between a printhead and the media is typically about 1 mm or less. Generally, a smaller gap is preferred in order to increase the accuracy of the printed image; however, the smallness of the gap is restricted since inkjet printheads can be damaged if the face of the printhead is contacted by the media. Replacing damaged printheads is expensive in the cost of the printheads and the down time for the printing device.

A "print zone" means a volumetric space defined by a plane of the print surface of the media, a width of the printhead(s) in which the printhead(s) are configured to eject ink, and a height extending between a relatively small distance above a printing face of the printhead(s) and at least the plane of the print surface. In an example, the height extends several millimeters above the nominal gap distance, and can represent a height at which the printhead(s) can eject ink onto the print surface with at least a predetermined threshold of accuracy.

FIG. 1 depicts a printing device 100 that includes a plurality of printheads 102*a-d*, actuator(s) 104, and a controller 106. The plurality of printheads 102*a-d* are positioned within a print zone 108, and are configured to eject ink onto an imaging surface 110 in order to form a portion of a printed image. The printheads 102*a-d* can be, for example, array print bars, to which a plurality of printheads are mounted to operate as single printhead ejecting a single color of ink such as cyan, magenta, yellow, or black ink, respectively. In an embodiment, the controller 106 is operatively connected to the plurality of printheads 102*a-d*, and is configured to cause the plurality of printheads 102*a-d* to eject ink with reference to image data for forming the image to be printed on the imaging surface 110.

When positioned a first distance 112 normal to the imaging surface 110, such as printheads 102*a-c* as illustrated in FIG. 1, the plurality of printheads 102*a-c* are enabled to accurately eject ink onto media passing through the print zone 108 in a process direction 114. The media can be passed through the printing device 100 by, for example, a media transport mechanism (not shown). The media can be, for example, cut sheets of print media, a continuous web of media, or the like. The first distance 112 defines the nominal gap between the plurality of printheads 102*a-d* and the imaging surface 110 for accurate printing of the printed image. In an example, the first distance is about 1 mm or less.

The actuator(s) 104 are operatively connected to the controller 106 and to the plurality of printhead 102*a-d*. The actuator(s) are configured to move the plurality of printheads 102*a-d* in a direction 116 that is normal to the imaging surface 110 between the first distance 112 from the imaging surface 110 and a second distance 118 from the imaging surface 110. The second distance 118 is greater than the first distance 112, but it is still within the print zone 108. In an example, the second distance 118 is 2 mm or less.

In other embodiments, the second distance 118 can be, for example, 4 mm, 6 mm, 10 mm, or 20 mm, or other distances, so long as the second distance 118 remains within the print zone 108. In another embodiment, the second distance 118 is less than or equal to a multiple of the first distance 112. For example, the second distance 118 can be defined as less than or equal to twice, three times, six times, etc., of the first distance 112. In one embodiment, different printheads in the printing device have different defined first or second distances 112, 118.

Distortions, edges, or other discontinuities in the media can pose a risk of damage to the plurality of printheads 102*a-d* from these defects striking one or more of the printheads. The plurality of printheads 102*a-d* is also at risk of contamination due to, for example, splashing or spraying ink ejected from surrounding printheads, or other particulates such as dust or media fragments. These risks can be minimized by adjusting the gap distance between the plurality of printheads 102*a-d* and the imaging surface 110.

Figure 2:
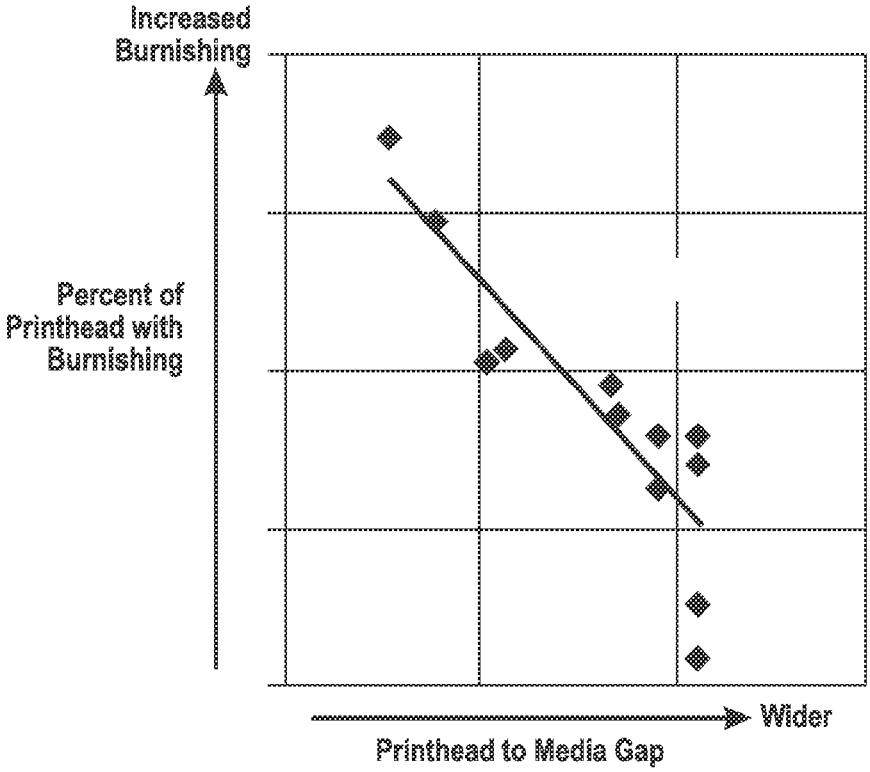
FIG. 2 is a graph of risk of printhead-media impacts for varying gap distances.

FIG. 2 illustrates a graph of the burnishing (impact) rate of a printhead over 10,000 feet of media over a variety of gap distances (HTP). As can be seen in FIG. 2, the rate of impacts generally decreases for an increase in gap distance, and thus increasing the gap distance in a printing device results in a decrease in risk of damaging the printheads. The graph in FIG. 2 illustrates results for a continuous web of media, and thus does not account for cases in which media edges of cut sheets impact printheads. Gap adjustments should not interrupt the printing process or impact the quality of the printed image. Devices have been produced that adjust a gap distance to compensate for a detected distortions, but the increase in gap distance between the printheads and the imaging surface results in a decrease in fidelity of the printed image, and does not address the risk of contamination. Such devices are also typically too slow for use in high-speed printing.

Returning to FIG. 1, in order to reduce damage and contamination of the plurality of printheads 102*a-d* without interrupting the printing process or impacting the quality of the printed image, the controller 106 is further configured to identify at least one printhead, such as the printhead 102*d*, that is not to be used for at least a portion of at least one print job to be completed by the printing device, and to operate an actuator 104 to move the identified printhead 102*d* to be the second distance 118 from the imaging surface. This movement enables the identified printhead 102*d* to be at the second distance 118 during the portion of the at least one print job in which the identified printhead 102*d* is unused.

Because the printhead 102*d* is still within the print zone 108 when at the second distance 118 from the imaging surface 110, the actuator moves the printhead by a relatively small distance, and the time period needed to move the printhead 102*d* between the first distance 112 and the second distance 118 is relatively short. The increased gap distance of the second distance 118 relative to the first gap distance 112, however, decreases the risk of damage to the printhead 102*d* by distortions or contaminants in the media because the burnishing ratio (FIG. 2) is decreased due to the increase in the length of web that passes before the printhead is struck. Additionally, since an end face 120 of the printhead 102*d* is spaced apart from the other printheads that are ejecting ink during the portion of the at least one print job in which the printhead 102*d* is unused, the risk of contamination due to ink ejected by other printheads is also decreased.

Further, since only printheads identified to be unused during the portion of the at least one print job are the only ones moved, the print job continues uninterrupted by the unmoved printheads which are used during the portion of the print job, such as printheads 102*a-c*. Since these printheads are positioned at the first distance 112 from the imaging surface 110, they are enabled to eject ink to form the ink image accurately. By moving unused printheads to the second distance 118 from the imaging surface 110, the risk of damage and contamination to the printheads at the second distance is reduced without interrupting the printing process or impacting the accuracy of the printed image.

In an embodiment, the controller 106 is further configured to identify at least one printhead as unused with reference to a predetermined threshold amount of printing in which the at least one printhead is to be unused. For example, a printhead can be identified as being unused when it does not need to be actuated to eject ink for: a predetermined number of consecutive sheets of media to be printed by the printing device; a predetermined span of media passing in the process direction 114, a predetermined time period, or other predetermined factors obtained from analyzing the image data used to form an ink image for at least one print job.

When the portion of the at least one print job in which the printhead 102*d* is unused has been completed, the controller 106 is further configured to operate one of the actuator(s) 104 to move the printhead 102*d* to be the first distance 112 from the imaging surface 110. Because, as described above, the time period for the movement between the first distance 112 and the second distance 118 is short, the printhead 102*d* is promptly enabled to eject ink to form portions of the image after the portion of the at least one print job in which the printhead 102*d* is unused has been completed. Consequently, no break in the printing process occurs between the portion in which the printhead 102*d* is unused and subsequent portions where the printhead 102*d* is used.

In one embodiment, the controller 106 is configured to begin moving the printhead 102*d* to the first distance 112 slightly before the portion of the at least one print job in which the printhead 102*d* is unused is completed. This configuration of the printhead enables the printhead 102*d* to be at the first distance 112 at or before a time period in which the printhead 102*d* is to be used to eject ink to form part of an ink image.

In an example, the printing device 100 is optimized for high speed printing, and the controller 106 can move the printheads 102*a-d* between the first distance 112 and the second distance 118, for example, multiple times while printing an image on a single media sheet, or multiple times per second. In other words, the threshold for identifying a printhead to be unused is sufficiently low to be optimized for high speed printing.

While FIG. 1 illustrates a single printhead 102*d* as being identified as unused and moved to be the second distance 118 from the imaging surface, the reader should understand that the controller 106 can be configured to identify and move multiple printheads simultaneously, in sequence, in groups, or independently as desired. Furthermore, various mechanisms and devices familiar to one of ordinary skill in the art are usable as or with the actuator(s) 104 for moving the printheads 102*a-d* as described herein. Several exemplary embodiments of such devices are described below, but the reader should understand that other conventional devices and mechanisms are also contemplated.

Figure 3:
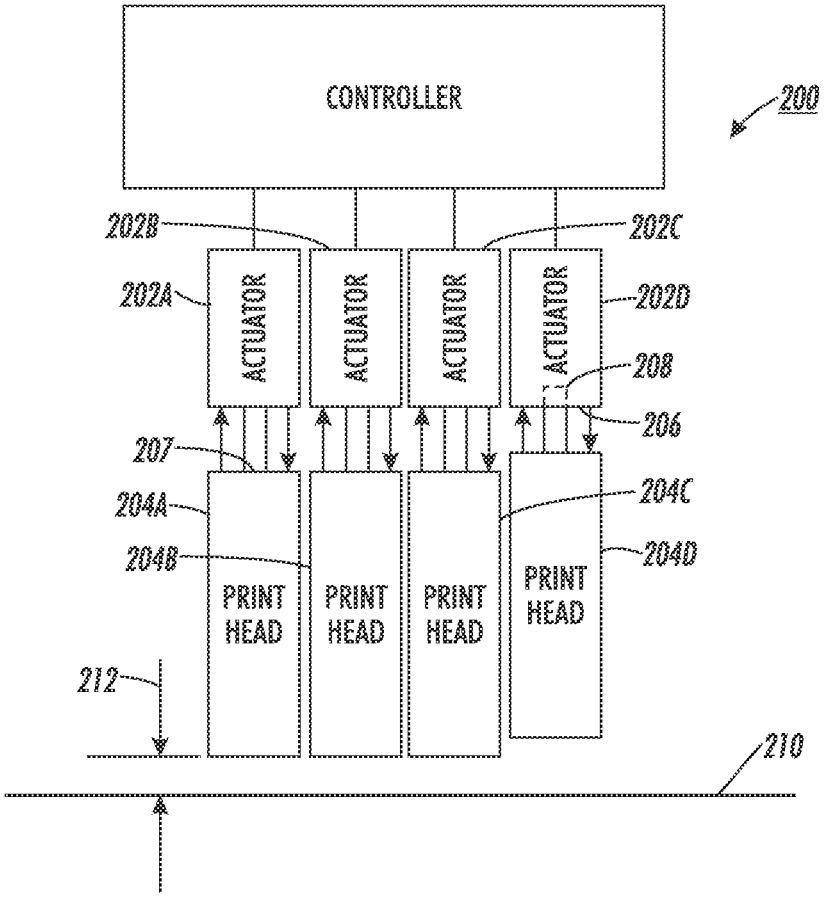
FIG. 3 and FIG. 4 are schematic side views of different exemplary embodiments of actuator(s) for a printing device that reduces printhead damage and contamination in a printing device.

FIG. 3 illustrates an exemplary embodiment of an actuation unit 200 that includes a plurality of actuators 202*a-d* that are operatively connected, respectively, to a corresponding one of the plurality of printheads 204*a-d*. Since each of the printheads 204*a-d* is assigned a respective actuator 202*a-d*, the printheads 204*a-d* can be respectively identified as used or unused and moved independently of each other. The actuators 202*a-d* can be linear actuators, and can include, for example, a piston, a camshaft, a pulley or hoist, a gear or gear train, a hydraulic actuator, pneumatic actuator, piezoelectric actuator, a screw drive, a chain drive, a linear motor, or other types of linear translation devices.

In an embodiment, the actuators 202*a-d* include a stop surface 206 configured to define a maximum extent of motion that the printheads 204*a-d* can be moved away from the imaging surface 210. In other words, the stop surface 206 in actuator 202*d* is configured to engage with the printhead 204*d* to arrest movement of the printhead 204*d* when the printhead 204*d* reaches a distance from the imaging surface 210 at which the printhead 204*d* contacts the stop surface 206. In one embodiment, each of the printheads 204*a-d* includes a stop surface 207, which is configured to engage with a corresponding actuator 202*a-d* or stop surface 206.

In another embodiment, the actuators 202*a-d* further include a second stop surface 208 configured to define a maximum extent of the motion of the printheads 204*a-d* towards the imaging surface 210. In other words, the second stop surface is configured to prevent the print heads 204*a-d* from moving closer than the first distance 212 from the imaging surface 210. The stop surfaces 206, 207, 208 can enable accurate motion of the printheads 204*a-d*, which can minimize or eliminate a need to register a location of the printheads 204*a-d* before operating the printheads 204*a-d* to eject ink accurately.

Figure 4:
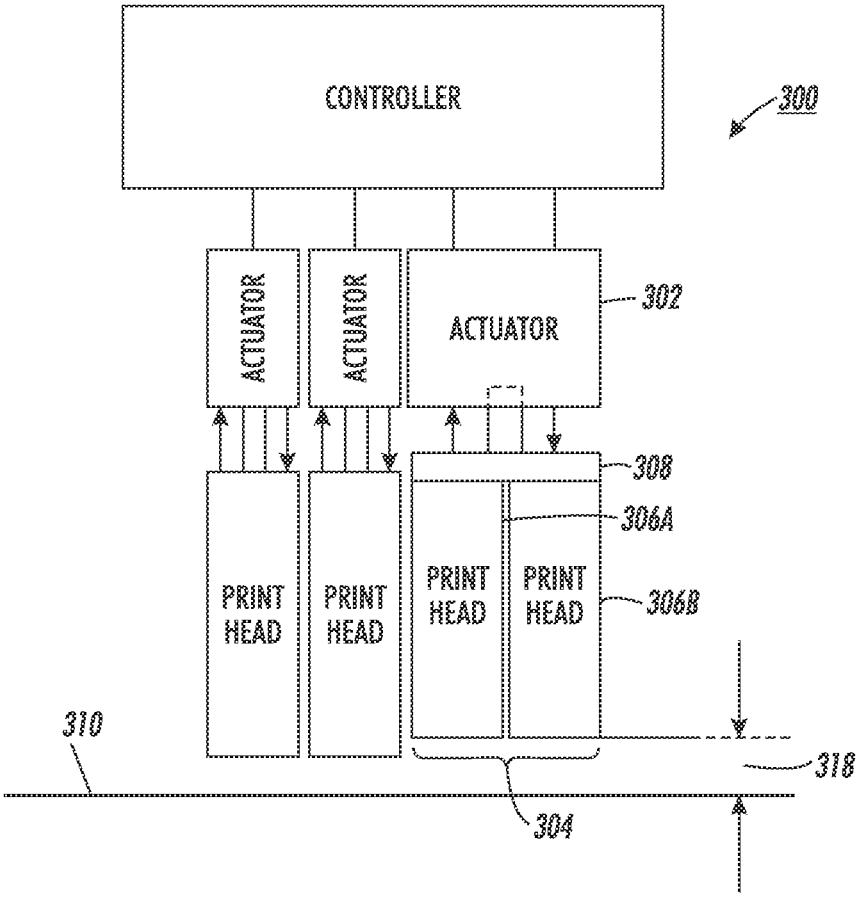

FIG. 4 illustrates an exemplary embodiment of an actuation unit 300 that includes an actuator 302 assigned to a predetermined group of printheads 304. The actuator can be a linear actuator, similar to the actuators 202*a-d* (FIG. 3), but this actuator is configured to move the printheads 306*a* and 306*b* simultaneously within the group 304. Predetermined groups of printheads can be, for example, printheads that are commonly associated in terms of use or non-use. In an example, a group of printheads can include CMYK printheads, monochrome printheads, printheads loaded with custom color ink or extended gamut ink, and a single-color group of printheads, whereby printheads within a group are either customarily used or unused contemporaneously with other printheads within the group.

When a group of printheads is identified as to be unused during a portion of at least one print job, the actuator 302 enables moving the group of printheads to be the second distance 318 from the imaging surface 310. By using a single actuator 302 to move an entire group of printheads 304, the number of total actuation devices can be decreased relative to, for example, when each printheads is assigned a respective actuator as shown in the embodiment of FIG. 2. While the group 304 illustrated in FIG. 4 includes two printheads 306*a* and 306*b*, groups of printheads can include any number of printheads.

In an embodiment, printheads 306*a* and 306*b* within a group 304 are each separately operatively connected to the actuator 302. In another embodiment, the printheads 306*a* and 306*b* are mounted within a carriage 308 that is operatively connected to the actuator 302. While the carriage 308 is illustrated as being on a side of the printheads 306*a* and 306*b* facing away from the imaging surface 310, various arrangements of the carriage are contemplated, such as on a region of the printheads 306*a* and 306*b* proximate to the imaging surface 310 as is the case with carriages 608 and 614 in FIG. 7.

Other arrangements for moving printheads in groups are also contemplated. In an example (not shown) a gearing mechanism or other device is configured to engage printheads selective for actuation by a single actuator. In other words, the controller identifies printheads to be unused, and an engagement mechanism engages the identified printheads with an actuator configured to move the identified printheads to the second distance from the imaging surface.

Figure 5:
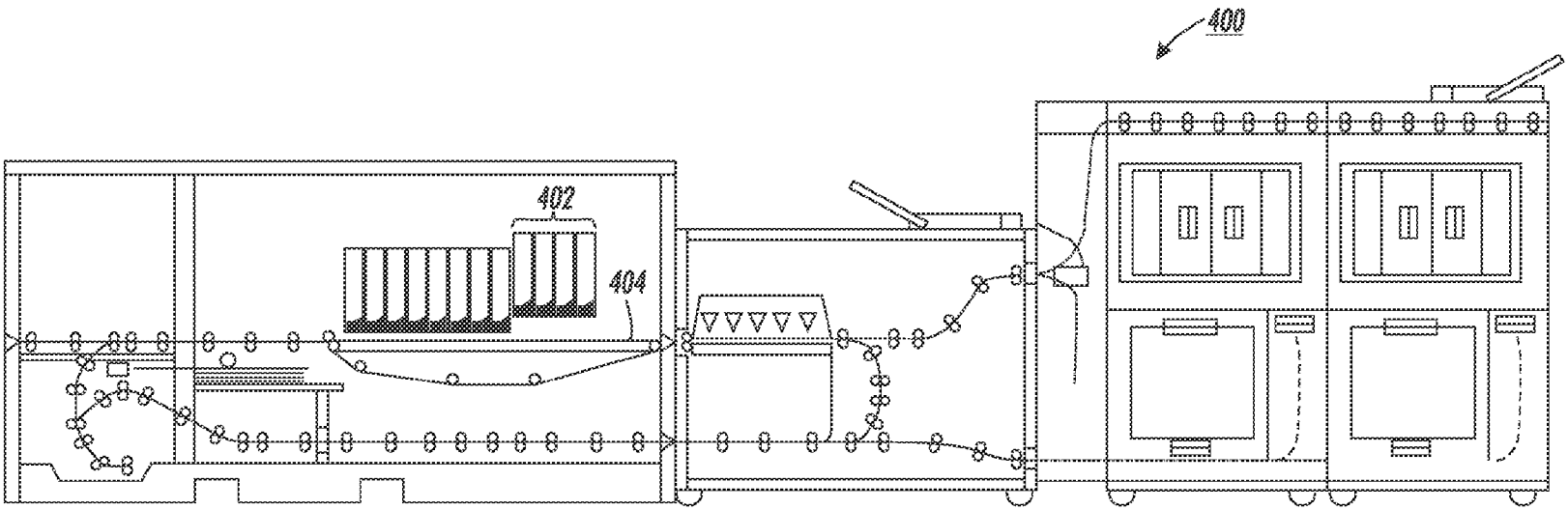
FIG. 5 is a schematic side view of an exemplary embodiment of a cut-sheet printing device that reduces printhead damage and contamination in a printing device.
Figure 6:
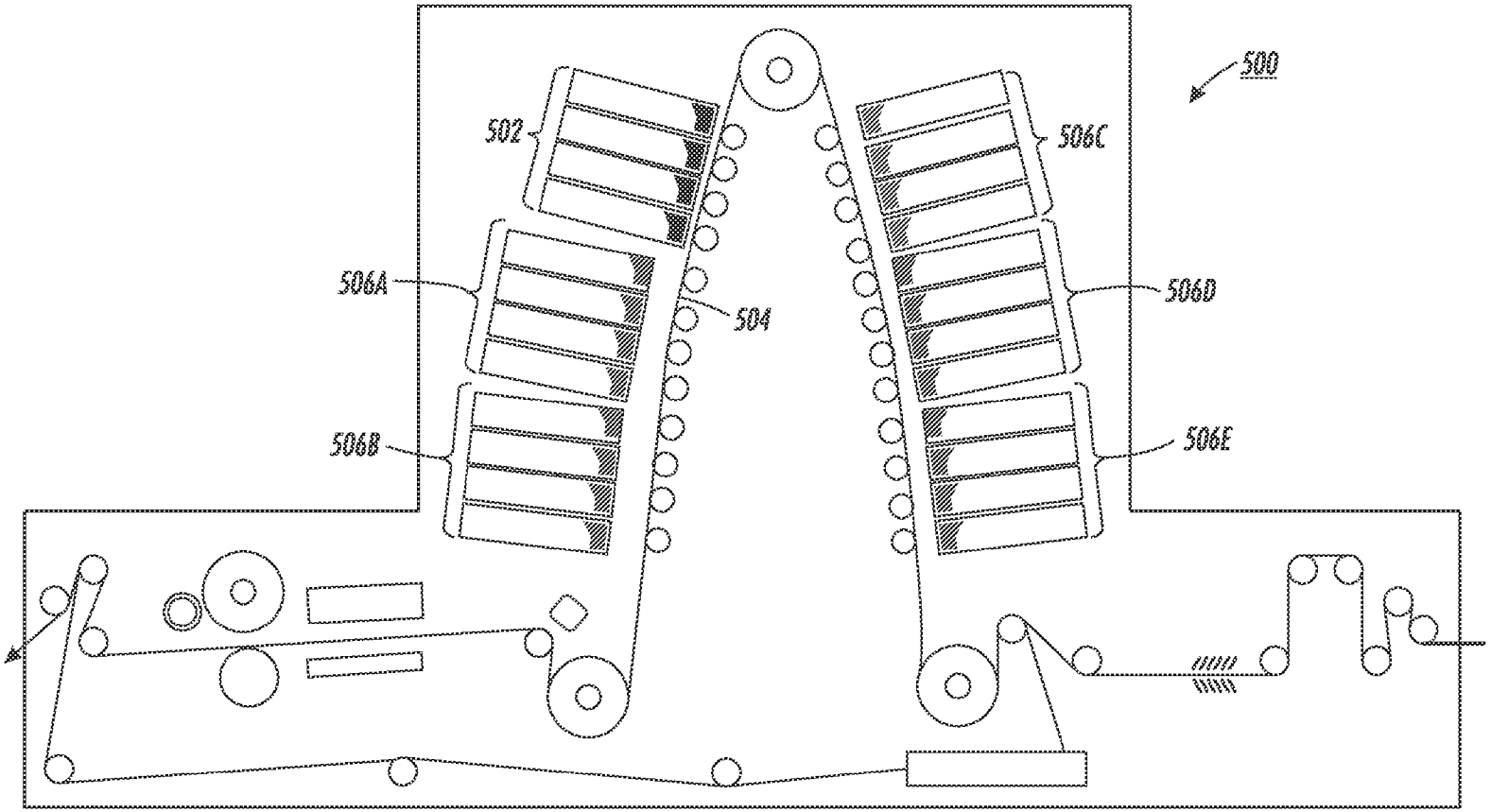
FIG. 6 is a schematic side view of an exemplary embodiment of a continuous-feed printing device that reduces printhead damage and contamination in a printing device.

FIG. 5 illustrates an exemplary cut-sheet media printer 400 where a group of printheads 402 has been moved away from an imaging surface 404 according to the disclosure, and FIG. 6 illustrates an exemplary continuous-feed printer 500 where a group of printheads 502 are positioned to eject ink on an imaging surface 504 and groups of printheads 506*a-e* have been moved away from the imaging surface 504. In FIG. 5 and FIG. 6, the actuator(s) and controller are not shown in order to illustrate other features of the printers 500, 600. As shown in FIG. 6, while each group of printheads is configured to move in a direction that is normal to the imaging surface 504, the imaging surface may not be planar, and thus the directions of motion for each group may be different in order to be normal to the imaging surface 504 in each case.

Figure 7:
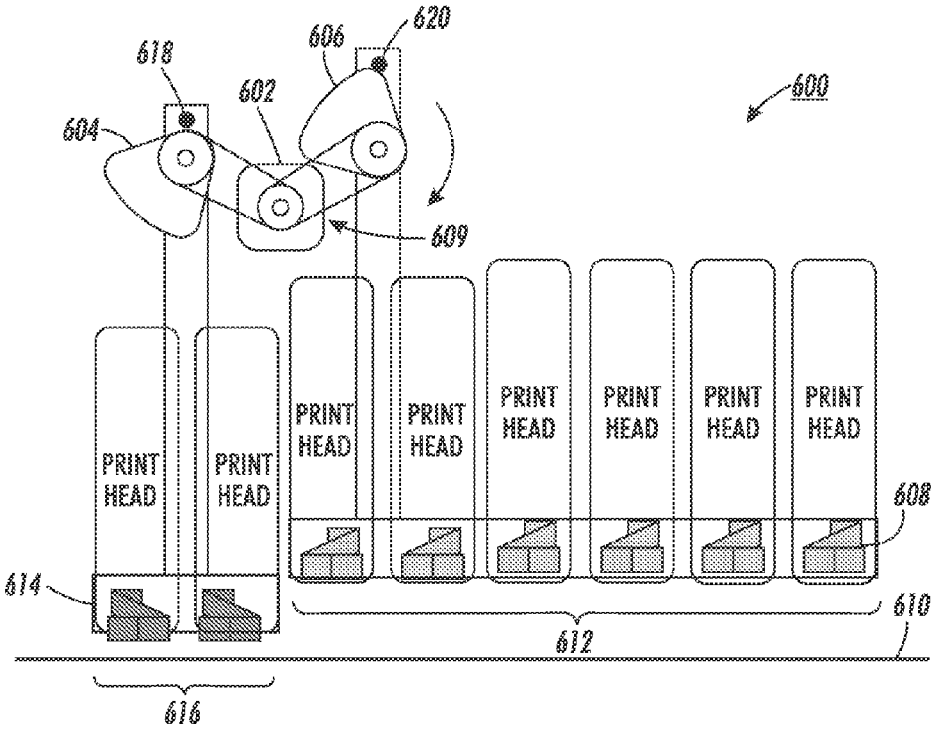
FIG. 7 is a schematic side view of a further exemplary embodiment of common drive actuator(s) for a printing device that reduces printhead damage and contamination in a printing device.

FIG. 7 illustrates an exemplary embodiment of an actuator 600 that is configured to move printheads away from the imaging surface 610 according to a predetermined sequence. In the present embodiment, the actuator 600 includes a driver 602, a first cam 604, and a second cam 606. The driver is, for example, an electric motor. The cams 604, 606 are driven by, for example, belt drives 609 that operatively connect the cams 604, 606 with the driver 602. Each cam 604, 606 is respectively operatively connected to at least one printhead, such as a carriage 608 of a first group of printheads 612 and a carriage 614 of a second group of printheads 616 respectively.

As illustrated in FIG. 7, the cams 604, 606 are configured to enable the driver 602 to engage the first cam 602 to move the first group 612 away from the imaging surface 610, and then engage the second cam 604 to move the second group 616 away from the imaging surface 610. Additional cams operatively connected to additional groups can be included to move the additional groups in sequence. The cams 602, 604 can be configured to move the first group 612 and then the second group 616 such that both groups are moved away from the imaging surface 610, or can be configured such that the groups 612, 616 are alternatingly moved towards and away from the imaging surface. In other words, the cams 602, 604 can be configured such that moving the group 612 towards or away from the imaging surface 610 corresponds to moving the second group 616 away or towards the imaging surface 610 respectively. Other arrangements for an actuator configured to actuate multiple printheads or groups of printheads in sequence, such as arrangements using actuators other than cams or belt drives, are also contemplated.

In an embodiment, pins 618 and 620 positioned on the cams 604 and 606 respectively limit an extent of rotation of the cams 604, 606. In an example, since the cams 604, 606 are driven by the belt drive 609, when the cam 606 reaches its extent of rotation as shown in FIG. 7, the first carriage 608 remains raised while the second carriage 614 begins to rise. The position of the pins 618 and 620 can also enable a precise limitation on the range of motion of the carriages.

Figure 8:
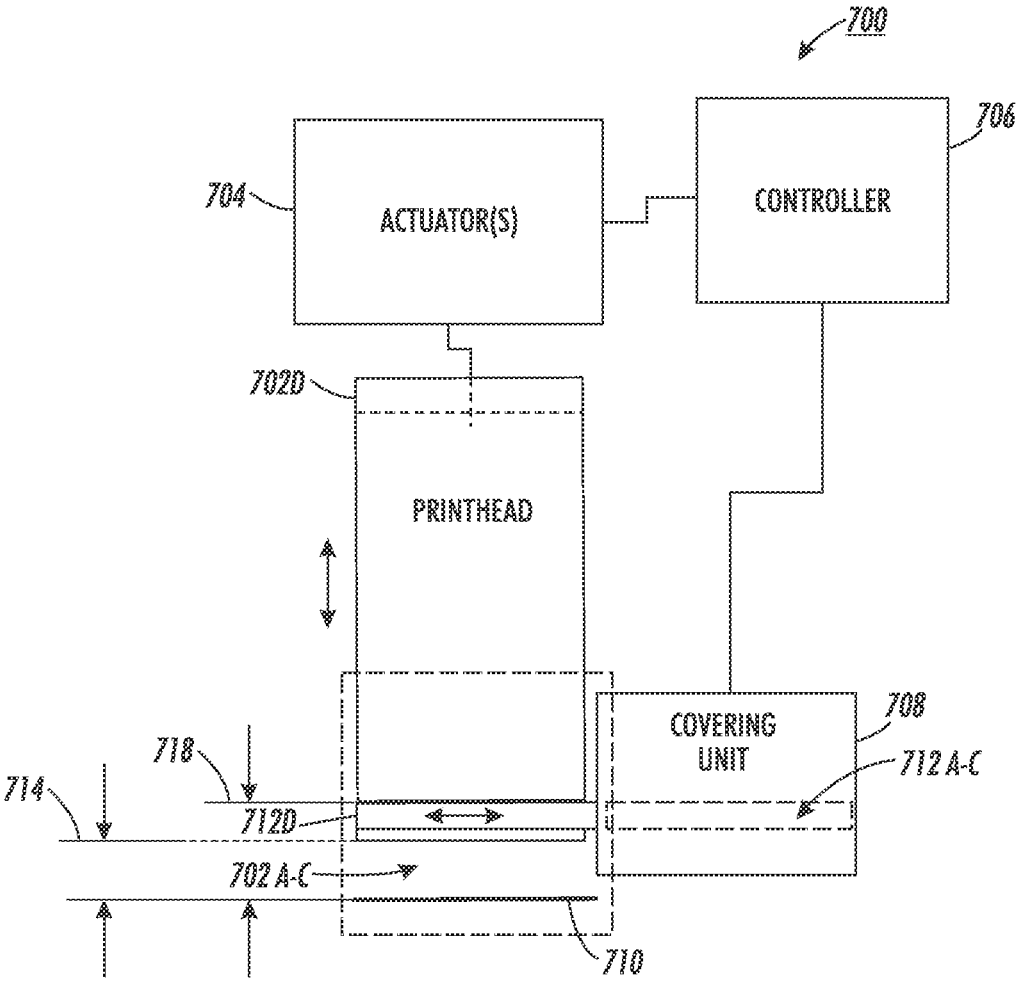
FIG. 8 is a schematic front view of a system for reducing printhead damage and contamination.
Figure 9:
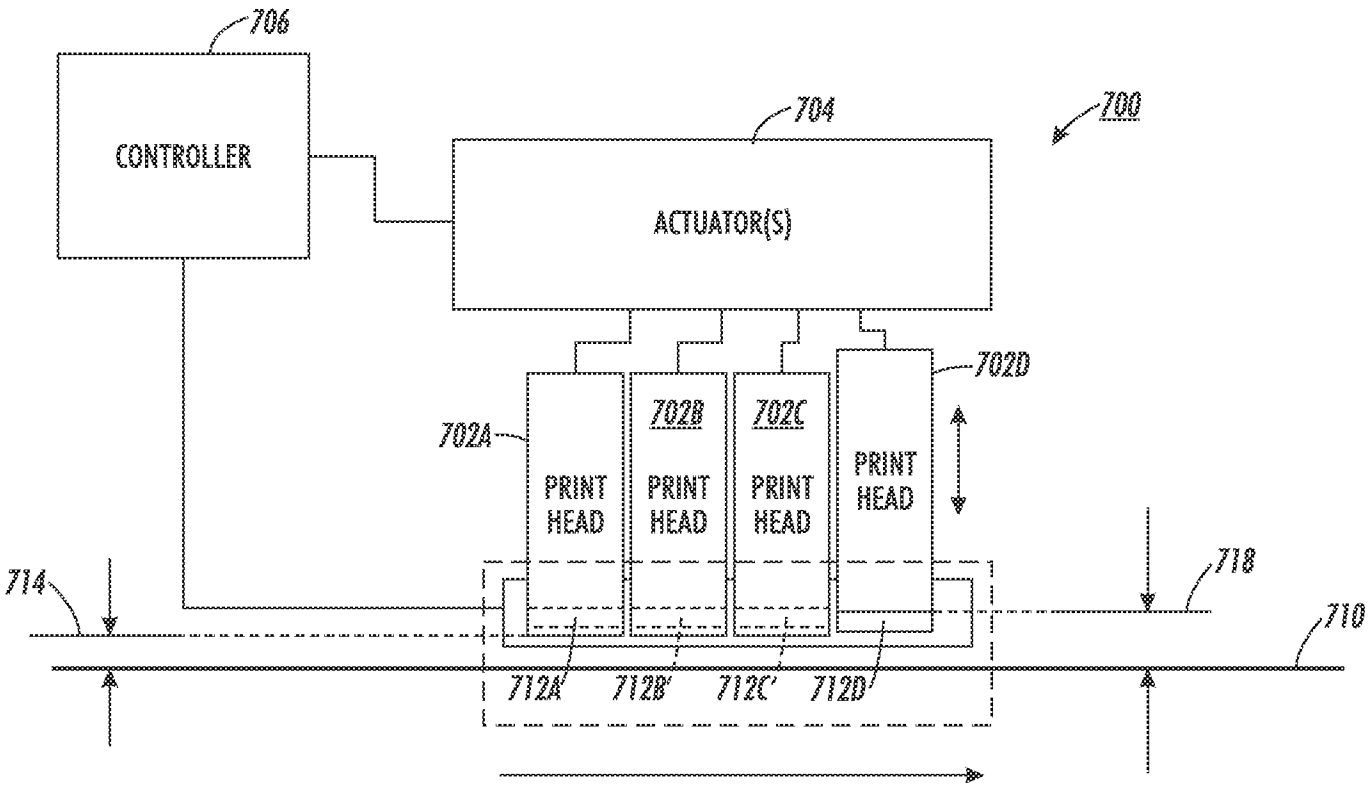
FIG. 9 is schematic side view of the system of FIG. 8.

While moving printheads to be the second distance from the imaging surface decreases the risk of contaminants such as ejected ink and other particulates from impacting the printheads, additional protection from contaminants for the printheads may be beneficial. FIG. 8 illustrates a front view of a printing system 700 that includes a plurality of printheads 702*a-d*, an actuator(s) 704, a controller 706, and a covering unit 708, and FIG. 9 is a side view of the printing system 700. The covering unit 708 is operatively connected to the controller 706, and is configured to cover the at least one printhead 702*d*, identified by the controller 706 as being unused for a print job portion and as being positioned at the second distance 718 from the imaging surface 710 with a corresponding member 712*d*. Covering the printhead 702*d*, with the member 712*d*.

The member 712*d* is configured to protect the printhead 702*d* from the ejected ink of other printheads 702*a-c* as well as other particulates or contaminants within the printing system 700. Additional members 712*a-c* correspond with the additional printheads 702*a-c* but are not illustrated as covering the printheads 702*a-c* since the printheads 702*a-c* are to be used during the at least one print job and are at the first distance 714 from the imaging surface 710.

In an embodiment, the members 712*a-d* are caps configured to at least temporarily close off the corresponding printheads 702*a-d*. The covering unit 708 can include, for example, a respective actuator for each member 712*a-d* that is configured to move the corresponding member 712*a-d* in a cross-process direction such that the members 712*a-d* cover or do not cover the printheads 702*a-d* as desired. Other types of covering members are also contemplated, such as hinged members that pivot to cover a printhead, as well as absorbent pads, wipers, vacuum caps, and the like.

If a printhead is unused for an extended period of time, a risk exists that ink remaining on a face of the printhead can result in a blockage or damage to the printhead. In an embodiment, the controller 706 is further configured to eject ink from the at least one identified printhead 702*d* into the member 712*d* covering the at least one printhead 702*d* at predetermined intervals during the portion of the print job in which the at least one printhead 702*d* is unused. In an example, the predetermined interval is about once per second, once per minute, or another time interval based, for example, upon characteristics of the printhead 702*d* or the ink. In an embodiment, the covering unit 708 includes a cleaner mechanism (not shown) that is configured to clean ink ejected into the members 712*a-d*.

Figure 10:
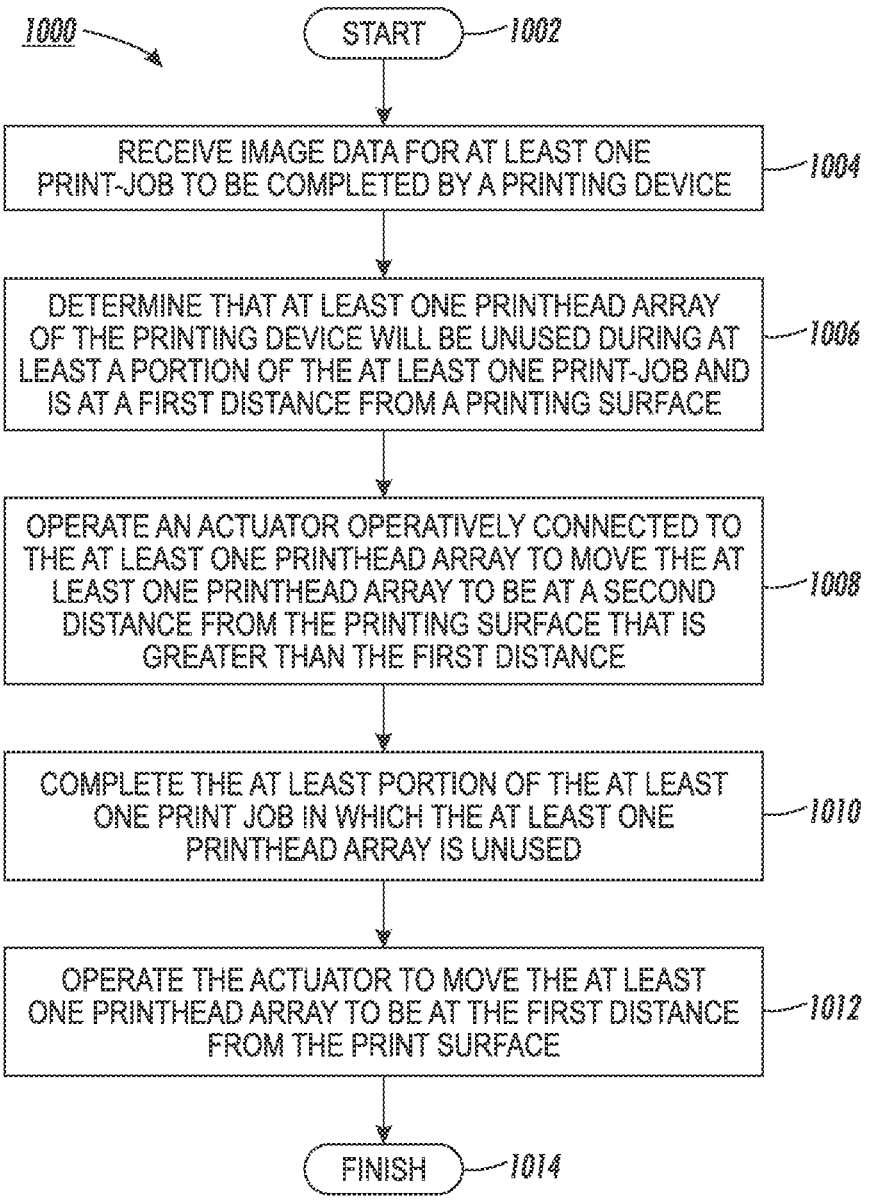
FIG. 10 is a flow chart illustrating an exemplary process for controlling a printing device that facilitates reducing printhead damage and contamination.

FIG. 10 illustrates an exemplary process 1000 for controlling a printing device that facilitates reducing printhead damage and contamination. The process 1000 can be performed, for example, by a controller of the printing device as well as other systems or components of the printing device or in communication with the printing device. The process 1000 is initiated (block 1002) and the printing device receives imaging data corresponding to one or more ink images for at least one print job to be completed by the printing device (block 1004). The controller performing the process determines that at least one printhead array of the printing device is unused for at least a portion of the at least one print job, and determines that the at least one printhead array is at a first distance from a printing surface upon which the ink image is to be printed (block 1006). The determination is made with reference to the image data, and can be based on, for example, a threshold amount of printing in which the at least one printhead array is unused, a period of time in which the at least one printhead array is unused, or other factors.

The controller operates an actuator operatively connected to the at least one printhead array to move the at least one printhead array to a second distance from the printing surface, where the second distance is greater than the first distance (block 1008). In one embodiment of the process, multiple actuators are operated to move multiple identified printhead arrays. In another embodiment, a single actuator is operated to move a plurality of printhead array, either simultaneously or in sequence. The process continues with the printing device completing the portion of the at least one print job in which the at least one printhead array is unused (block 1010) and the controller operates the actuator to move the at least one printhead array to again be the first distance from the print surface (block 1012). In one embodiment, the controller begins to operate the actuator to move the at least one printhead array to again be the first distance from the print surface before the printing device completes the portion of the at least one print job in which the at least one printhead array is unused to enable the at least one printhead array to be at the first distance from the print surface when the portion of the at least one print job concludes. The process is finished (block 1014) until another print job is ready for printing.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating an array printing device comprising:

identifying at least two printhead arrays that are not to be used for at least a portion of at least one print job to be completed by the printing device, each of the identified printhead arrays in the at least two identified printhead arrays having a plurality of printheads that form an array that extends in a cross-process direction across a print zone in the printing device, the at least two identified printhead arrays being configured for movement between a first distance from a surface that enables the at least two identified printhead arrays to eject ink for forming a portion of an ink image on the surface within the print zone of the printing device and a second distance from the surface within the print zone, the second distance being greater than the first distance; and operating an actuator to rotate a first cam to move one of the at least two identified printhead arrays in a direction normal to the surface on which the ink image is formed to the second distance from the surface within the print zone to enable the one identified printhead array to remain at the second distance from the surface during the portion of the at least one print job in which the one identified printhead array is unused and to rotate a second cam after the one identified printhead has reached the second distance from the surface to move the other printhead array in the at least two printhead arrays to the second distance from the surface to enable the other printhead array in the at least two printhead arrays to remain at the second distance from the surface during the portion of the at least one printhead job in which the at least two identified printhead arrays are not used.

2. The method of claim 1, the identification of the at least two printhead arrays further comprising:

identifying the at least two printhead arrays with reference to a predetermined threshold amount of printing.

3. The method of claim 2 wherein the predetermined threshold amount of printing corresponds to a predetermined number of consecutive media sheets to be printed in the print zone in which the identified at least two identified printhead arrays are unused.

4. The method of claim 1 wherein the printheads in the at least two identified printhead arrays are at least one of CMYK printheads, monochrome printheads, printheads loaded with extended gamut inks, printheads loaded with custom color ink, and printheads of a single-color.

5. The method of claim 1 further comprising:

covering each printhead array in the at least two identified printhead arrays with a member during the portion of the print job in which the at least two identified printhead arrays are unused; and ejecting ink from the at least two identified printhead arrays into the member covering the at least two identified printhead arrays at predetermined intervals during the portion of the print job in which the at least two identified printhead arrays are unused.

6. The method of claim 1 further comprising:

moving the at least two identified printhead arrays to the first distance from the surface after the portion of the print job in which the at least two identified printhead arrays are unused has been completed.

7. A printing device comprising:

a plurality of printhead arrays, each having a respective plurality of printheads that form an array extending in a cross-process direction across a media path within a print zone in the printing device;

an actuator configured to rotate a first cam to move a first printhead array in a direction normal to a surface on which an ink image is to be formed and to rotate a second cam to move a second printhead array in a direction normal to the surface on which the ink image is to be formed, the actuator being configured to move the first and the second printhead arrays between:

a first distance from the surface that is within the print zone and that enables the first and the second printhead arrays to eject ink for forming a portion of the ink image on the surface; and a second distance from the surface that is within the print zone and is greater than the first distance; and a controller operatively connected to the actuator, the controller being configured to:

identify the first and the second printhead arrays as unused for at least a portion of at least one print job to be completed by the printing device and as being at the first distance from the surface; and operate the actuator to move the first identified printhead array to the second distance from the surface and to move the second identified printhead array to the second distance from the surface after the first identified printhead array has reached the second distance to enable the first and the second identified printhead arrays to remain at the second distance from the surface during the portion of the at least one print job in which the first and the second identified printhead arrays are unused.

8. The printing device of claim 7, the controller being further configured to:

identify the first and the second printhead arrays with reference to a predetermined threshold amount of printing in which the first and the second identified printhead arrays are unused.

9. The printing device of claim 8 wherein the predetermined threshold amount of printing corresponds to a predetermined number of consecutive media sheets to be printed in the print zone for which the first and the second identified printhead arrays are unused.

10. The printing device of claim 7 further comprising:

a covering unit configured to cover the at first and the second identified printhead arrays with a member during the portion of the at least one print job in which the first and the second identified printhead arrays are unused.

11. The printing device of claim 10, the controller is further configured to:

eject ink from the first and the second identified printhead arrays into the member covering the first and the second identified printhead arrays at predetermined intervals during the portion of the print job in which the first and the second identified printhead arrays are unused.

12. The printing device of claim 7, the controller is further configured to:

move the first and the second identified printhead arrays to the first distance from the surface after the portion of the print job in which the first and the second identified printhead arrays are unused has been completed.

13. The printing device of claim 7, wherein the second distance is less than six times the size of the first distance.

* * * * *